United States Patent [19]

Russell

[11] Patent Number: 4,596,294

[45] Date of Patent: Jun. 24, 1986

[54] SURFACE CONTROL BENT SUB FOR DIRECTIONAL DRILLING OF PETROLEUM WELLS

[76] Inventor: Larry R. Russell, 6025 Edgemoor, Suite C, Houston, Tex. 77081

[21] Appl. No.: 368,993

[22] Filed: Apr. 16, 1982

[51] Int. Cl.[4] ..... E21B 7/08

[52] U.S. Cl. ..... 175/74; 175/317

[58] Field of Search ..... 175/74, 317, 256, 71, 175/67; 166/321, 319, 72

[56] References Cited

U.S. PATENT DOCUMENTS

| | | | |
|---|---|---|---|
| 2,669,429 | 2/1954 | Zublin | 175/74 |
| 2,812,821 | 11/1957 | Nelson | 166/225 |
| 3,190,374 | 6/1965 | Caperan et al. | 175/74 |
| 3,365,007 | 1/1968 | Skipper | 175/317 |
| 3,976,136 | 8/1976 | Farley et al. | 166/319 |
| 4,220,176 | 9/1980 | Russell | 175/318 |
| 4,286,676 | 9/1981 | Nguyen | 175/74 |
| 4,303,135 | 12/1981 | Benoit | 175/256 |
| 4,374,547 | 2/1983 | Nguyen | 175/74 |

FOREIGN PATENT DOCUMENTS

| | | | |
|---|---|---|---|
| 272218 | 5/1970 | U.S.S.R. | 175/74 |
| 407026 | 4/1974 | U.S.S.R. | 175/74 |
| 583274 | 12/1977 | U.S.S.R. | 175/74 |

*Primary Examiner*—Stephen J. Novosad
*Assistant Examiner*—William P. Neuder
*Attorney, Agent, or Firm*—Carl B. Fox, Jr.

[57] ABSTRACT

Directional drilling apparatus for incorporation in a drill string, wherein a lower apparatus section is angularly deviated from vertical by cam action and wherein rotational displacement of the angularly deviated apparatus section is overcome by additional cam action, the apparatus being operated by successive increases and decreases of internal drill string pressure.

43 Claims, 11 Drawing Figures

SURFACE CONTROL BENT SUB FOR DIRECTIONAL DRILLING OF PETROLEUM WELLS

The Government has rights in this invention pursuant to Contract No. DE-AC19-80BC10175.

BACKGROUND OF THE DISCLOSURE

Many apparatuses for use in guiding the drilling of a petroleum well in a non-vertical intentionally angular direction are available. In most of these, a lower portion of the apparatus is permanently and fixedly at an angle to the vertical upper portion of the apparatus and in some apparatuses the lower apparatus portion is adjustably or controllably angular. U.S. Pat. Nos. 3,457,999, 3,561,549, 3,563,323, 3,637,356, 3,667,556, 3,713,500, 3,811,519, 3,841,420, 3,903,974, 3,993,127, 4,077,657, and Russian Pat. Nos. 275,917, and 543,730 disclose various forms of directional drilling apparatuses. The above listed patents show various forms of apparatuses which have fixed deviation guide portions so that the drill string on passing therethrough is deviated at its lower end to cause angular drilling. The following patents show lateral deflectors for rotating drill pipe: U.S. Pat. Nos. 2,891,769, 3,023,821, 3,298,449, 3,326,305, 3,370,657, 3,424,256, 3,460,639, 3,565,189, 3,572,450, 2,593,810, 3,595,326, 3,599,733, 3,637,032, 3,650,338, 3,743,034, 3,746,108, 3,799,279, 3,825,081, 3,961,674, 3,974,886, 4,015,673, 4,076,084, 4,108,265, and Russian Pat. No. 616,395. Many of the tools described in these patents include means for monitoring the angular direction of the lower end of the drill string, same being necessary in order that a proper angular direction may be achieved. None of these patents mentioned provides a variable tool which is completely operable from the surface without tools run downhole to deviate the drill string in a desired direction, with need still to monitor, as deviation depends on rock dip, weight on bit, and the like. This invention seeks to provide an apparatus controllable completely from the surface, which will deviate the drill string at a desired angular direction and with complete control and certainty as to the direction at which the drill string will be deviated.

SUMMARY OF THE INVENTION

This invention provides a directional drilling tool which achieves angularity of its lower end portion through end-to-end engagement of angular surfaces, and which is controlled through a series of angles from vertical by operation of a barrel cam which rotates a lower end portion of the tool with respect to an upper portion to produce the angular deviation, and in which the angular deviations achieved are predetermined and accurate, the tool also providing rotational correction so that the angularly deviated tool portion is guided in the proper direction. Operation of the apparatus is achieved entirely by altering the fluid pressure within the drill string, controlled from the surface, and no auxiliary operating tools are used at all. No apparatus must be run or pumped down the drill string in order to achieve the desired results. The apparatus provided according to the invention provides accurate angular deviation in a drill string in a preselected direction with no downhole monitoring of the angular tool position (Azimuth) being necessary due to bend angle change.

A principal object of the invention is to provide improved directional drilling apparatus which is entirely controllable from the surface. Another object of the invention is to provide such apparatus which is simple, efficient, and dependable. Yet another object of the invention is to provide such an apparatus through use of which the drill string is deviated stepwise to the selected deviated direction, and in which the deviation is reversible. Yet another object of the invention is to provide such an apparatus which is actuated by pressures introduced into the well from the surface to cause actuation of barrel cam devices to provide tool sub angularity and to provide azimuthal correction. A still further object of the invention is to provide such an apparatus which is economical in manufacture and use. A still further object of the invention is to provide an apparatus which gives surface-detectable indication of actuation.

Other objects and advantages of the invention will appear from the following detailed description of a preferred embodiment, reference being made to the accompanying drawings.

BRIEF DESCRIPTIONS OF THE DRAWINGS

Figure 1:
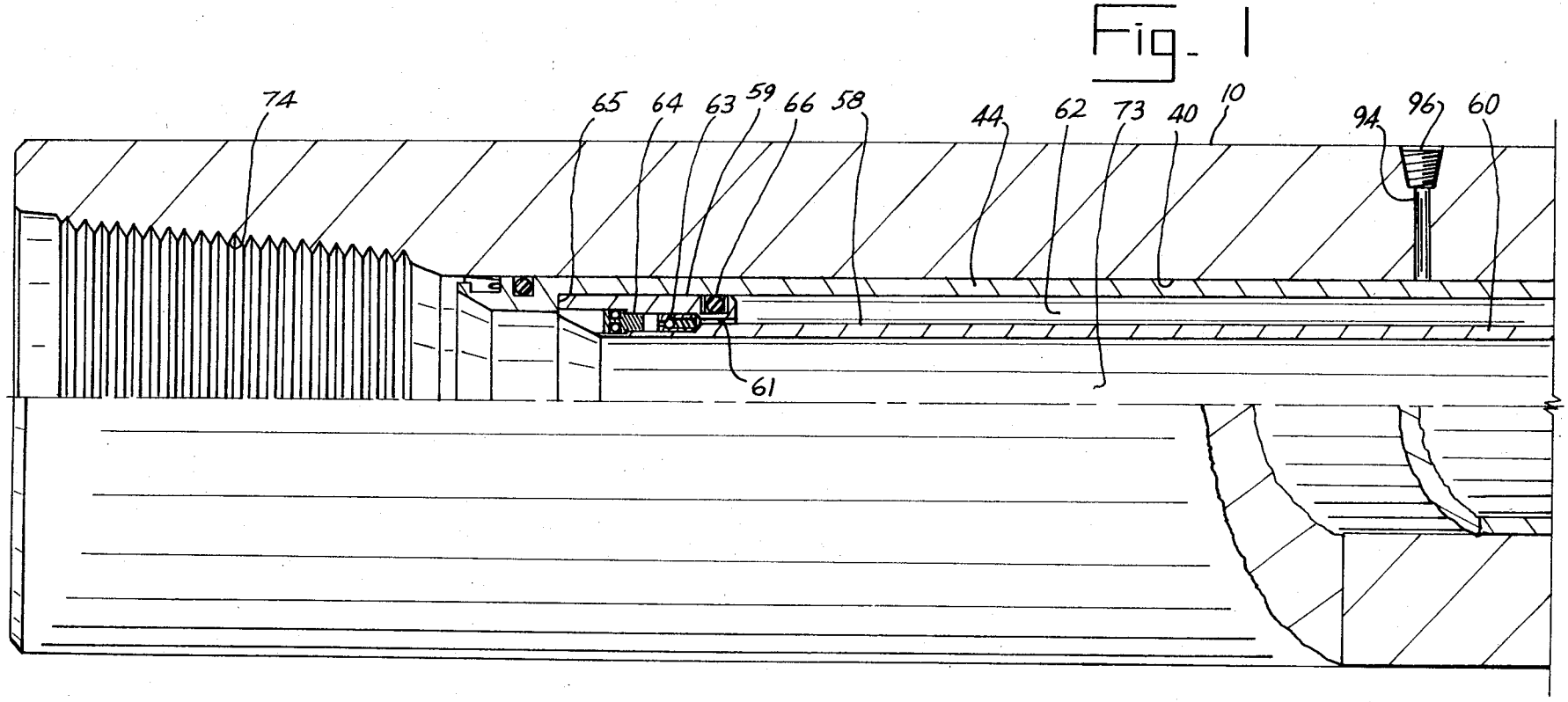
FIGS. 1–7 are axial quarter sections showing successive longitudinal portions of the complete apparatus, from top to bottom.
Figure 2:
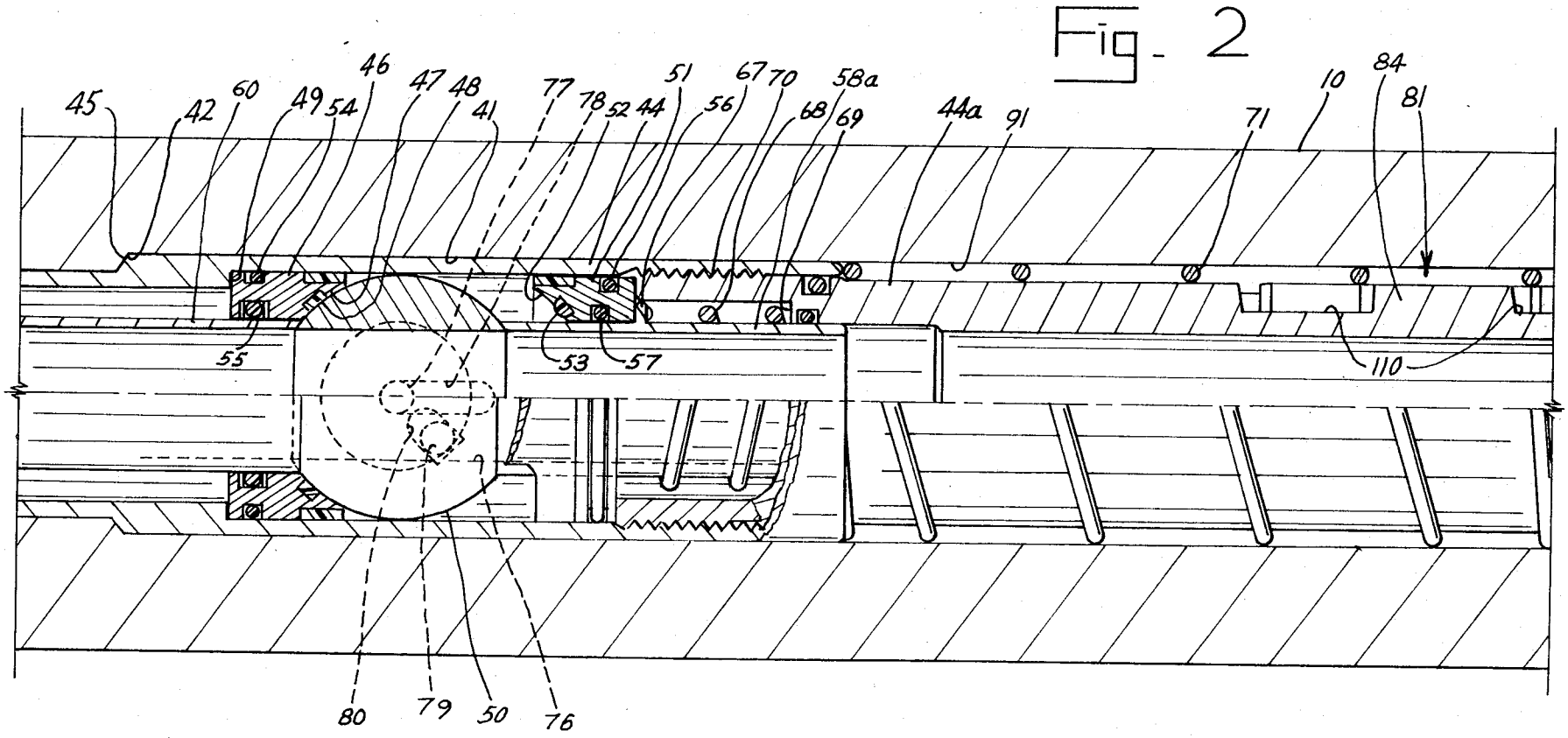
Figure 3:
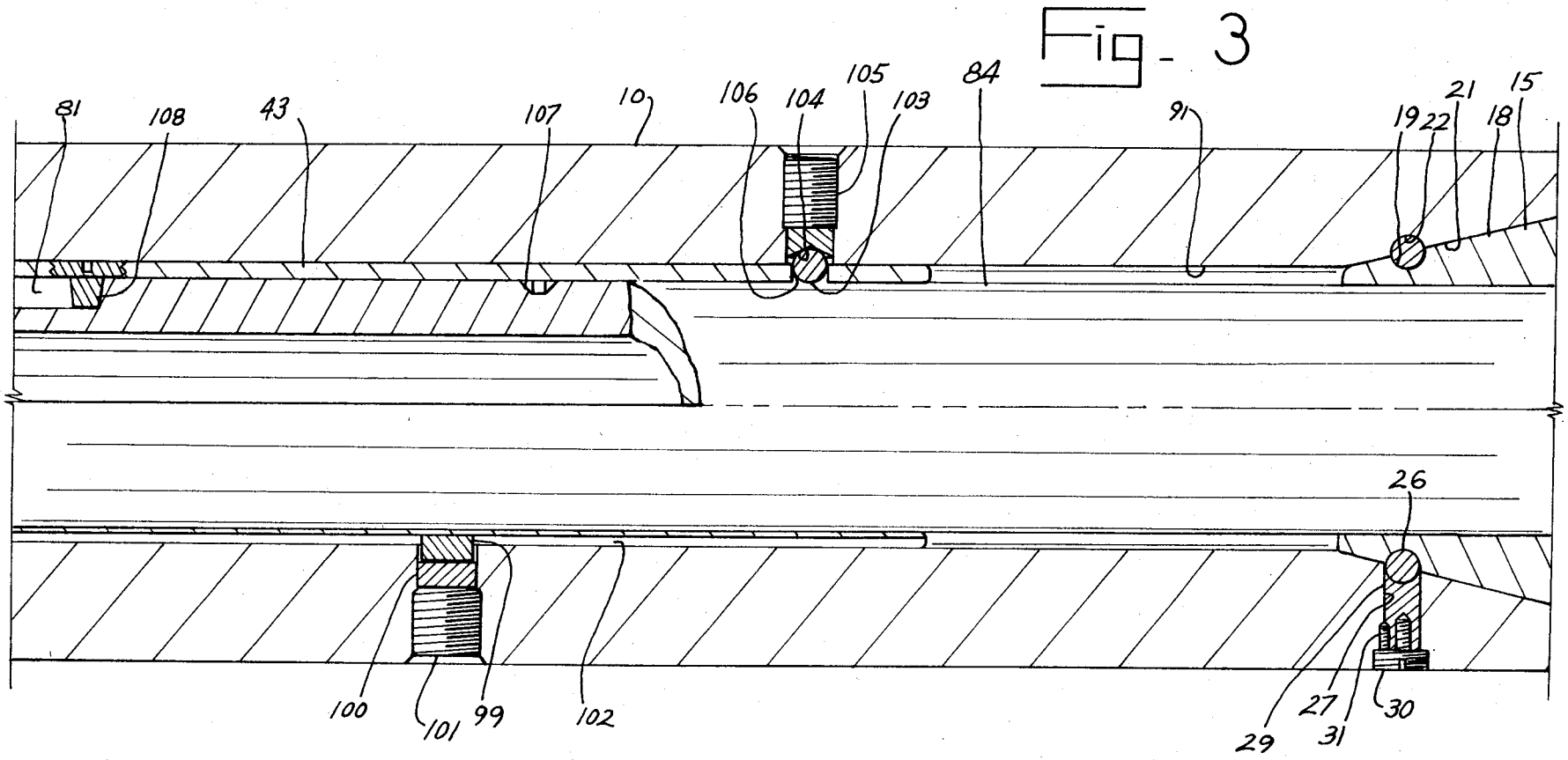
Figure 4:
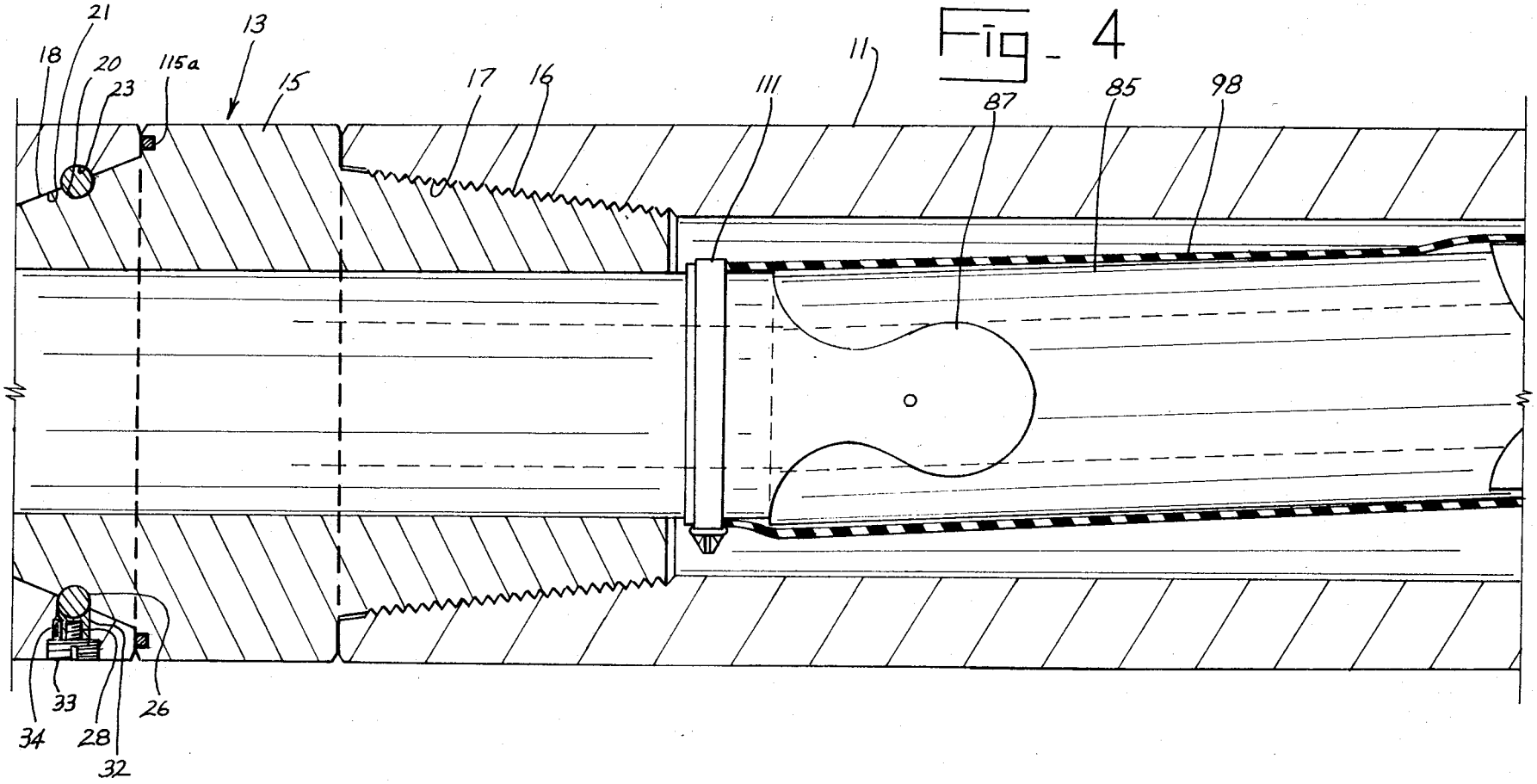
Figure 5:
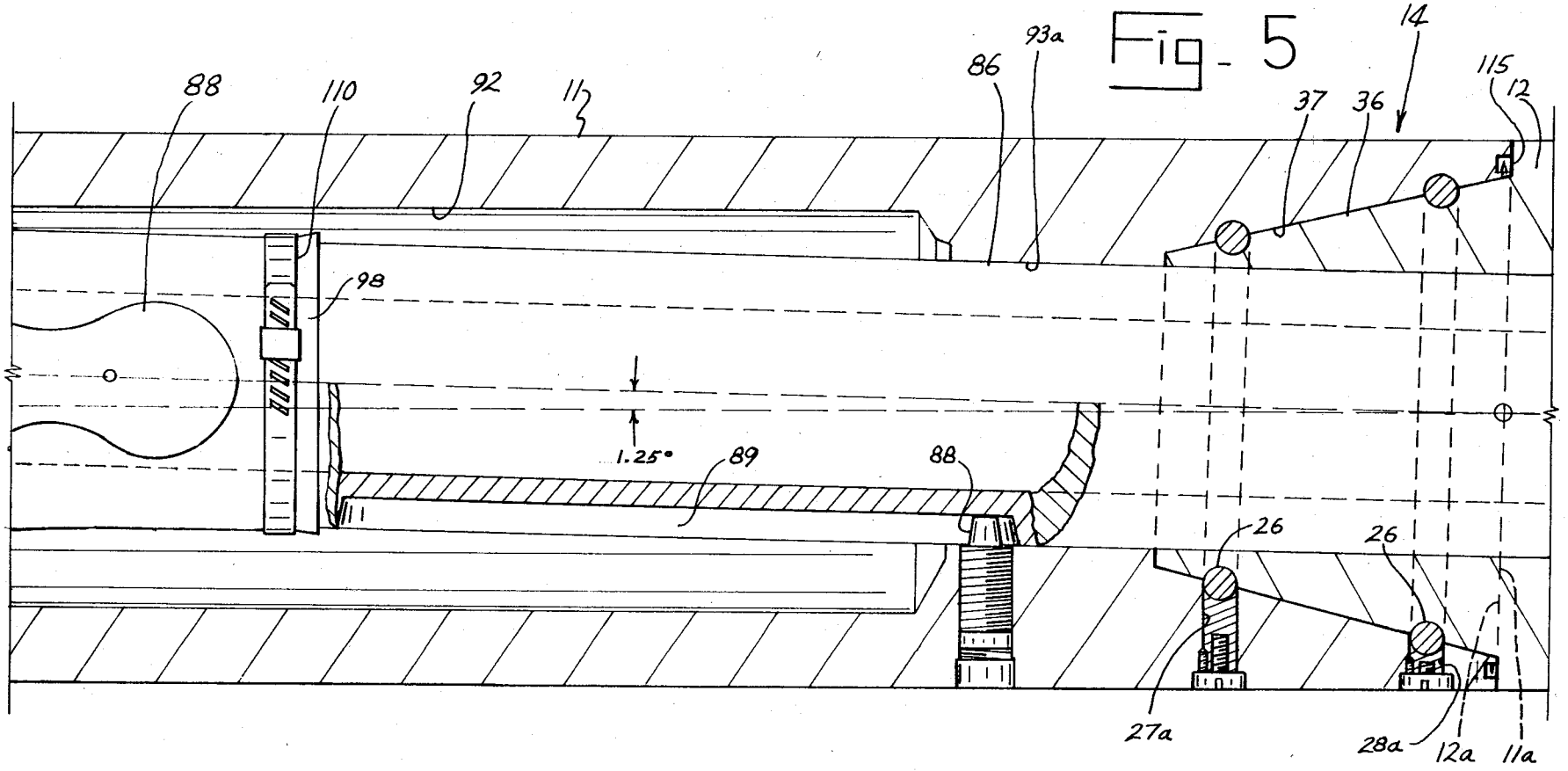
Figure 6:
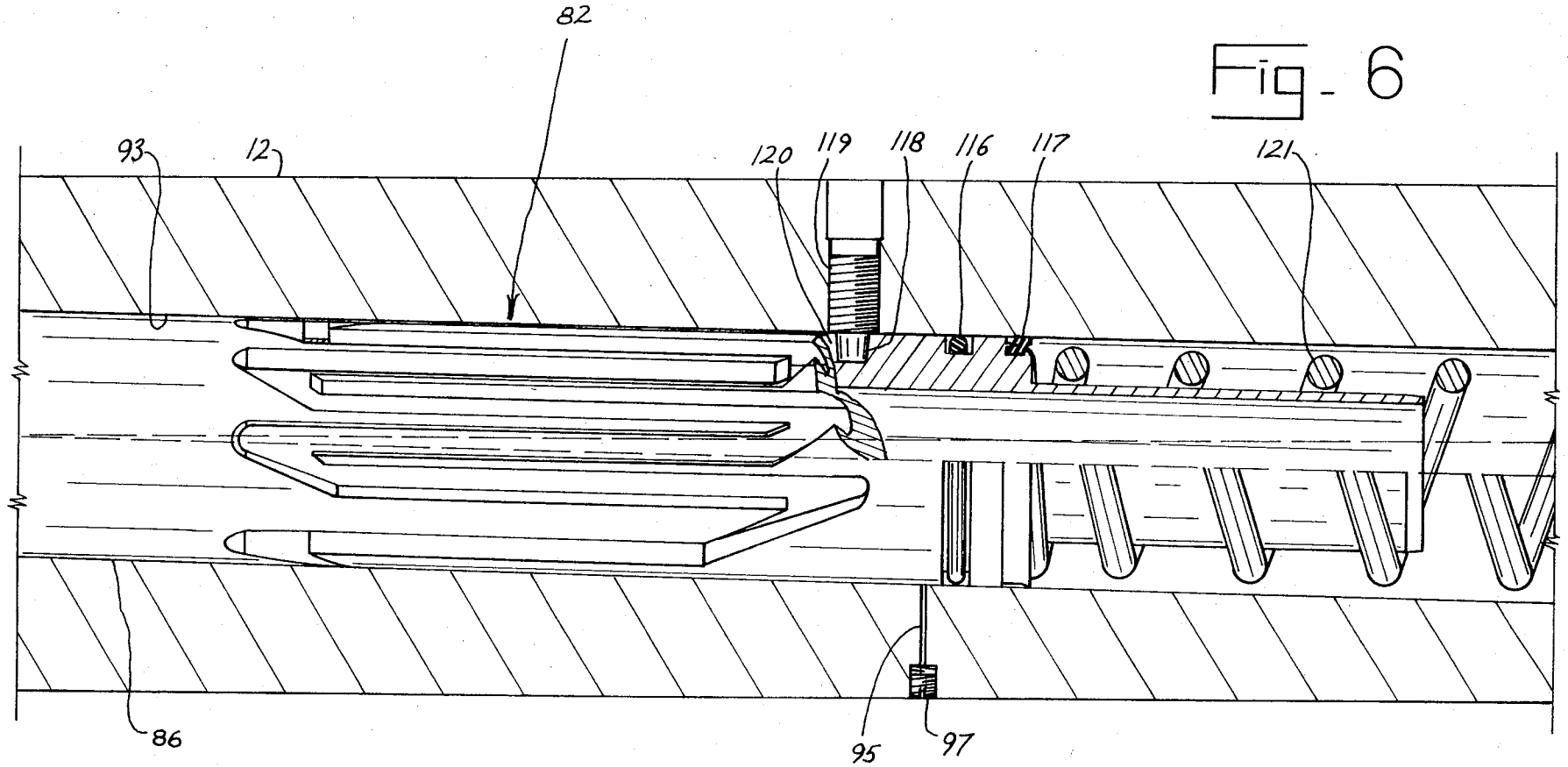
Figure 7:
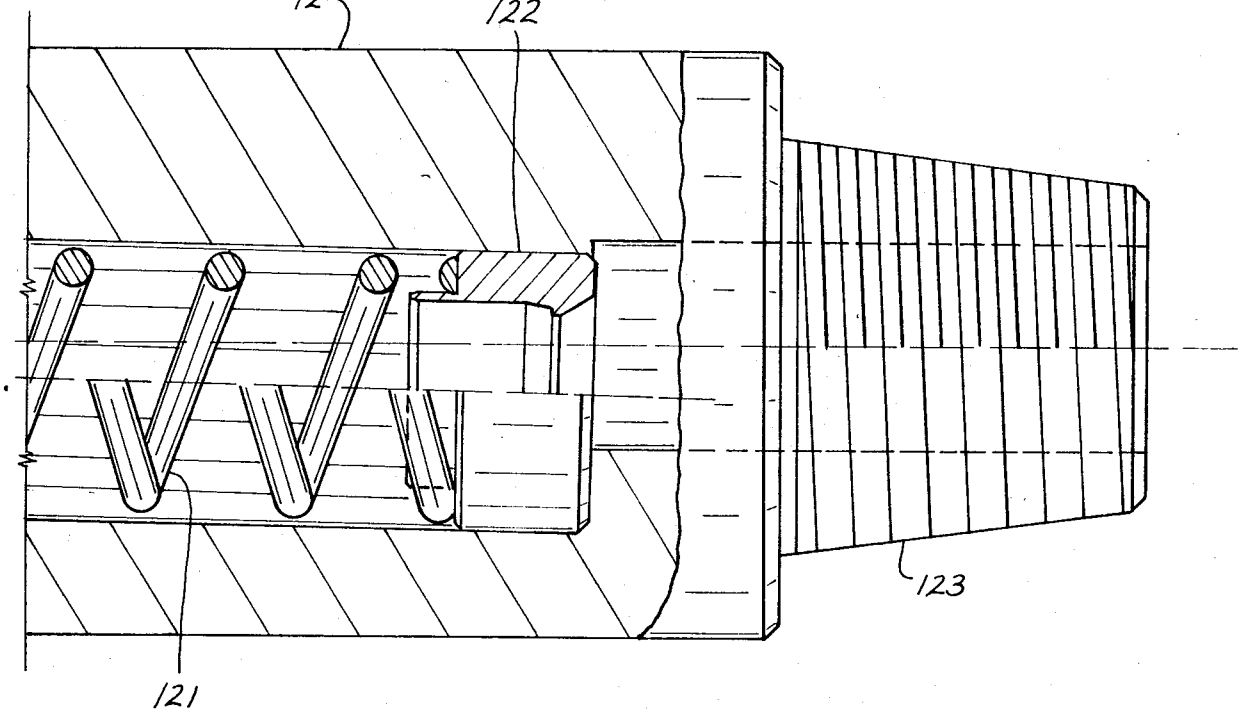
Figure 9:
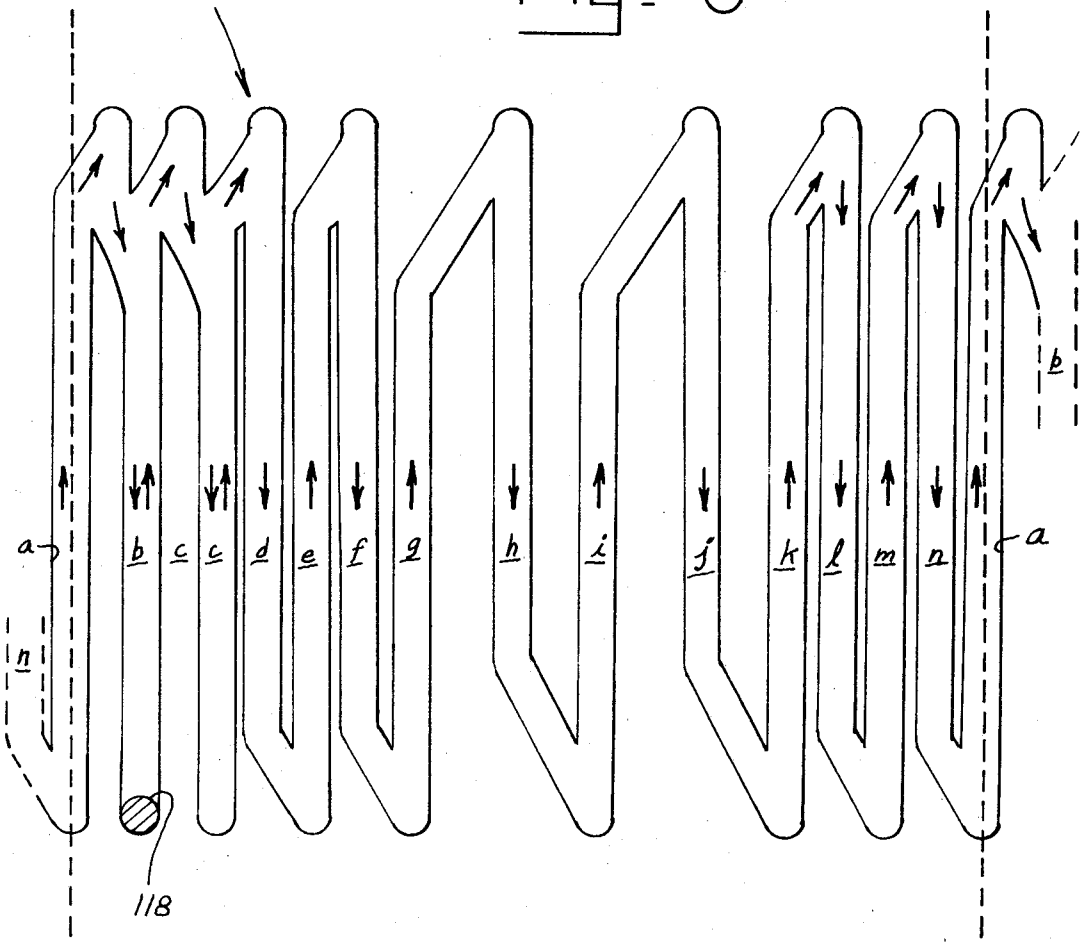
FIGS. 8–9 are drawings showing the upper and lower barrel cam configurations, respectively, used in connection with the apparatus of FIGS. 1–7.
Figure 8:
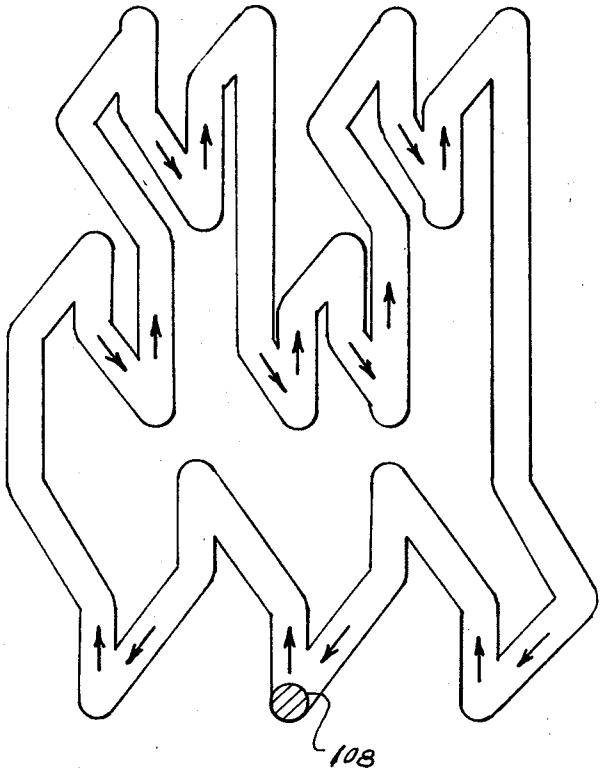
Figure 10:
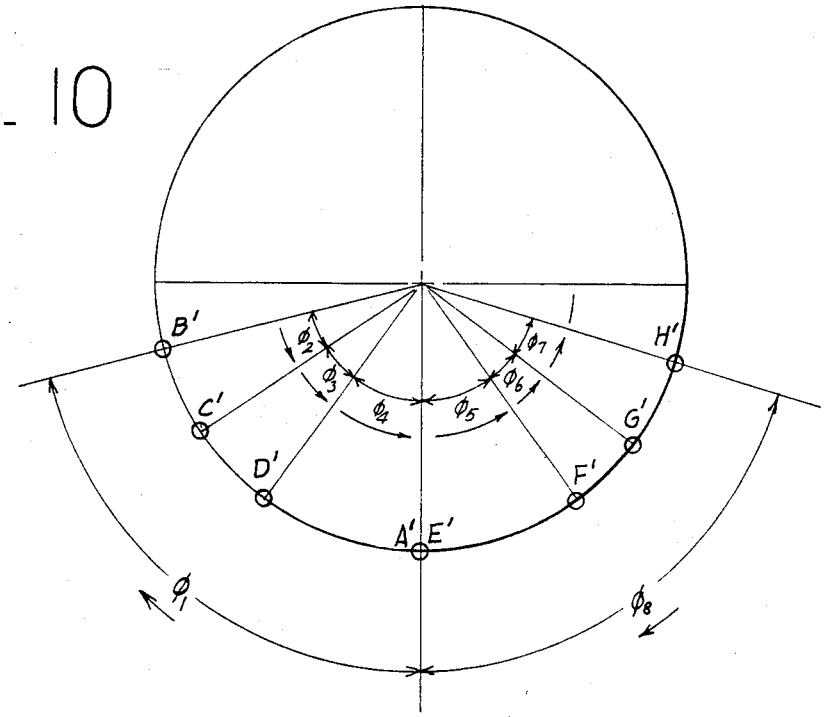
Figure 11:
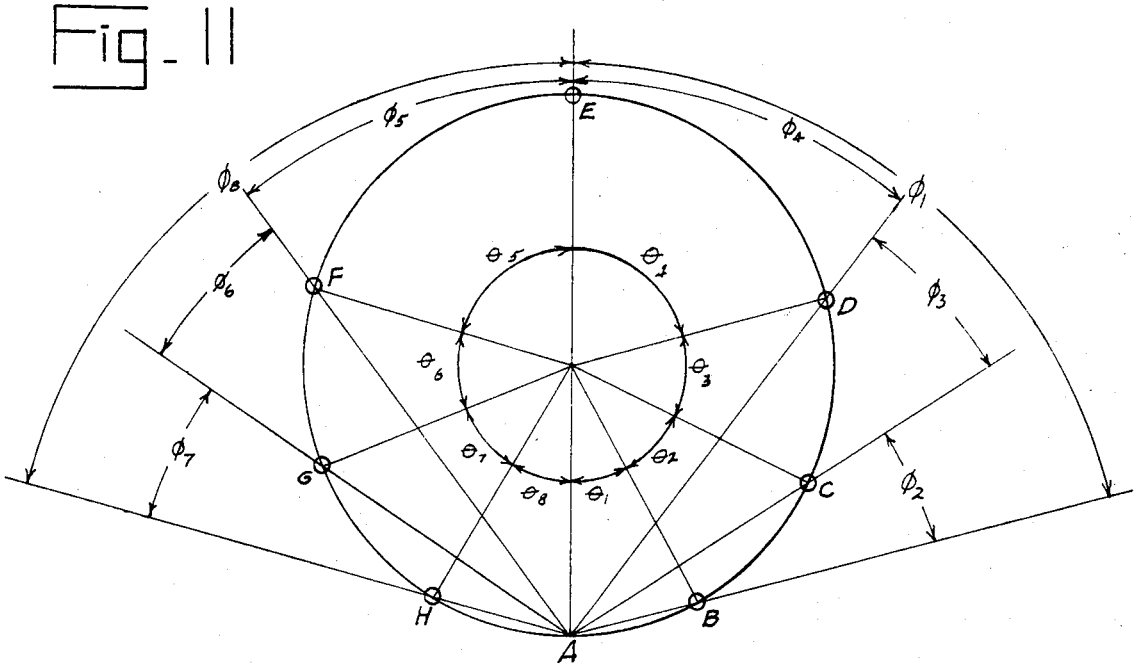

FIGS. 10–11 schematic drawings explaining the functions of the barrel cam grooves of FIGS. 8–9.

DESCRIPTION OF THE PREFERRED EMBODIMENT

Referring now to the drawings in detail, and first to FIGS. 1–7, the apparatus includes three main body sections, upper elongate tubular body member 10, middle elongate tubular body member 11, and lower elongate tubular body member 12, these being joined at joints 13 and 14. At joint 13, fitting 15 has threaded pin 16 which is screwed into threaded socket 17 of middle body 11. Fitting 15 has pin 18 having axially spaced semi-circular peripheral grooves 19, 20 therearound, socket 21 of body member 10 having corresponding semi-circular interior grooves 22, 23 therearound. Grooves 19 and 22, together form a circular passage of uniform circular cross section and grooves 20, 23 together form a circular groove of uniform circular cross section. These grooves of circular cross section are filled by bearing balls 26, introduced into grooves 19, 22 through port 27, and into grooves 20, 23 through port 28. A pin 29 having a semi-circular groove across its end is held in place by screwed in plug 30 rotationally fixed by pin 31 inserted into a drilled opening formed at the intersection of pin 29 with the wall of port 27. Bearing balls 26 are introduced into grooves 20, 23 through port 28 which is filled by a pin 32 held in place by plug 33 which is rotationally fixed in position by pin 34 inserted into a drilled opening at the intersection of pin 32 and port 28. The bearing balls 26 in the two circular cross sectional passageways prevent withdrawal of pin 18 from socket 21 and provide for rotation between adapter 15 and body member 10. The rotatable joint 13 is sealed by seal element 115A.

At joint 14, pin 36 of lower body member 12 is connected into socket 37 of middle body member 11 in the same manner that pin 18 is connected into socket 21. The bearing balls 26 introduced through ports **27*a* and 28*a* hold pin 36 within socket 37 yet permit rotation between body member 11 and 12. It should be noted however that lower end 11***a* of body member 11 and upper end 12*a* of body member 12 are not perpendicular to the axes of these members but are at a slight angle (1.25 degrees) such that when member 12 is rotated about its axis relative to body member 11, body member 12 will become angular with respect to body member 11. The angularity between members 11 and 12 depends on the degree of relative rotational movement therebetween, the angle being zero when the members are in their positions as shown and being maximum when member 12 is rotated 180° from the position shown in the drawings. Joint 14 is sealed externally by seal 115. Body member 10 has an axial passage 40 therethrough which is enlarged at its lower portion 41, below shoulder 42. A clutching sleeve 43 lines the lower end of passage portion 41.

The upper portion of passages 40, 41 is lined by sleeve-like valve ball housing 44, which has an outer annular shoulder 45 engaged with shoulder 42. A ring shaped valve seat member 46 has spherically shaped seat 47 having a seal 48 in a groove therearound, member 46 being disposed within valve ball housing 44 against shoulder 49. At the opposite side of valve ball 50 there is disposed another valve seat member 51 having spherical seat 52 around which is disposed a circular seal ring 53 in a suitable groove around the seat. Seat members 46, 51 are joined at opposite sides by unitary longitudinal plates (not shown) which support two opposite pins 79 in opposite ball slots 80. Opposite pins 77 are formed on valve ball 50. Slots 78 are formed in the longitudinal plates. The seats 46 and 51 are sealed inwardly and outwardly against adjacent members by O-rings 54, 55, 56, 57. A tubular piston member 58 is outwardly enlarged at 59 to fit flushly against the interior of valve ball housing 44. Between the thin walled lower portion 60 of piston 58 and valve ball housing 44 there is provided an accumulator chamber 62 which is controlled by check valve element 63 the passage to which is closed by plug 64 when not in use. Nitrogen gas under pressure, or the like, is introduced through check valve 63, with plug 64 removed, through passage 61 into accumulator space 62, before the apparatus is run into the well hole, and the pressure within accumulator 62 biases piston 58 in an upward direction to against a shoulder 65 at the interior of housing 44. An O-ring 66 is provided about housing portion 59, to seal between the piston and the housing 44. Pressure-balanced ball pusher 58A has therearound, below seat member 51, an outwardly protruding flange or collar 67 which rests against ball 50 when the piston 58 is in its upward position. A compression spring 68 is disposed between collar 67 and shoulder 69 at the interior of tube 44*a*, which is the upper portion of mandrel 84, to be further described later. Mandrel 84 is connected to housing 44 at threaded connection 70. A helical compression spring 71 is disposed between the lower end of housing 44 and the upper end of clutching sleeve 43. When pressured fluid is introduced into interior passage 73 through a drill string screwed into threaded socket 74 at the upper end of upper body member 10 and the pressure becomes higher than that in accumulator 62, then piston 58 is forced downwardly to compress spring 68, ball 50 being closed. Ball 50 is closed by rotation to move ball passage 76 to a transverse position by sliding of pins 77 in slots 78 while stationary pins 79 act in grooves 80 to cause ball rotation. Upon full downward movement of piston 58, the ball is rotated by 90° to move flow passage 76 to a position perpendicular to that shown in the drawing, thereby closing the ball valve against the lower seat member 51. Upon release of pressure within passage 73, the piston 58, ball 50, and ball pusher 58*a* are returned upwardly by spring 68, this causing opening of ball valve 50. Thus, when sufficiently pressured fluid is introduced into passage 73, piston 58 is moved downwardly to close ball valve 50, and when the pressure is relieved to a level only slightly above accumulator 62 pressure, the piston 58 moves upwardly and the ball valve 50 opens.

Briefly, the apparatus operates as follows: Middle body member 11 is rotatable with respect to upper body member 10. Lower body member 12 is rotatable with respect to middle body member 11. The engaged ends between body members 11 and 12 are angular, not perpendicular to the tool axis, so that the angle of the axis of body member 12 with respect to the axis of body member 11 (the tool axis) changes as body member 12 rotates with respect to body member 11. However, as the angle of the axis of body member 12 changes with respect to the axis of body member 11, the axis of body member 12 rotates about the tool axis. In order that this rotation of body member 12 will not occur in a fixed reference system, body member 11 is compensatingly rotated with respect to body member 10 so that as body member 12 rotates with respect to body member 11, the deviation angle of body member 12 remains in a single plane.

The relative rotation of body member 10 and 11 and of body members 11 and 12 are controlled by two barrel cams located internally in the tool at locations 81 and 82. The "rolled-out" or flattened projection of barrel cam 81 is shown in FIG. 8 and the "rolled-out" or flattened projection of barrel cam 82 is shown in FIG. 9.

A camming assembly is disposed within the bores of the body members 10–12. The camming assembly includes upper tube 84, linking tube 85, and lower tube 86. Upper tube 84 is joined to linking tube 85 at universal or U-joint 87 and linking tube 85 is joined to lower tube 86 at universal or U-joint connection 88. Tubes 84, 85, 86 are reciprocatingly movable upwardly and downwardly within body members 10–12. Lower tube 86 is constrained against rotation with respect to middle body section 11 by pin 88 which is slidably disposed in straight slot 89 at the upper end of lower tube 86. The bore 91 of upper body member 10 is coaxial with the body member, the upper bore 92 of middle body member 11 is coaxial with the body member and is enlarged in order to allow movements of the middle or linking tube 85 at universal joints 87, 88, and the lower bore 93A of middle body 11 and the bore 93 of lower body member 12 are angular or askew, as shown.

Oil injected through ports 94, 95, closeable by threaded plugs 96, 97, respectively, lubricates between camming assembly tube elements 84, 85, 86 and elements exterior thereof, and lubricates the balls 26 at the couplings between elements 10, 11 and 11, 12. Elastomeric sleeve 98 fixed around U-joints 87, 88 by band clamps 110, 111, prevents drilling mud from contaminating the lubricating oil around the camming assembly and when oil outside the camming assembly is depleted, expands to maintain the lubricating oil pressured. Guide cylinder 99 held by guide holder 100 and retained by a plug 101 screwed into body threads slides in single straight slot 102 in the exterior of clutching sleeve 43, to prevent rotation of the clutching sleeve with respect to upper body member 10. Detent ball 103 seated in recess formation 104 of plug 105 is normally engaged in opening 106 in clutching sleeve 43. When clutching sleeve 43 moves downwardly, with slide cylinder 99 sliding in groove 102, sink 107 is moved to the position of ball 103 and ball 103 enters the sink to become disengaged from detent holder 105. This action declutches sleeve 43 from body member 10 so that sleeve 43 carrying upper barrel cam pin 108 is freely movable longitudinally with respect to body member 10. Pin 108, screwed through a tapped opening through the wall of camming assembly sleeve 43, is engaged in the groove of upper barrel cam 81, the contour of which is shown in rolled out or flattened form in FIG. 8 of the drawings. The declutching of sleeve 43 from body member 10 prevents pin 108 from bottoming out in the short grooves of the upper barrel cam 81. Since camming assembly sleeve 43 cannot rotate within body member 10 because of slide cylinder 99 in slot 102, the camming action of barrel cam 81 causes rotation of upper camming assembly tube 84 within upper body member 10 and within connector adapter 15.

Elastomeric sleeve 98, previously mentioned, is held in place by band clamps 111, 110 which respectively clamp the upper end of the elastomeric sleeve to upper camming assembly tube 84 and the lower end thereof to lower camming assembly tube 86.

O-ring seals 116, and rod wiper seal 117 are provided around the lower end of camming assembly tube 86, as shown, to provide seals thereof with body member 12. Pin 118 carried by plug 119 screwed into a tapped opening through body member 12 engages a camming slot 120 in camming assembly tube 86 to control rotation of tube 86 with respect to lower body member 12. Helical compression spring 121 engages between the lower end of camming assembly tube 86 and a ported lower stop ring 122, and serves to return the camming assembly upward within body members 10–12 when fluid pressure above ball valve 50 is relieved. Lower body member 12 has at its lower end a threaded pin 123 for connection thereof to lower portions of the drill string.

When sufficiently pressured drilling fluid is introduced into passage 73 the increased pressure acts on the larger upper end of piston 58 to push the piston downwardly when the accumulator pressure is exceeded to close ball valve 50, as has already been explained. When ball valve 50 is closed, the increased pressure in passage 73 acting on the top of the closed ball valve pushes ball housing 44 downwardly, this also moving tubes 84–86 downwardly against the compression of springs 71 and 121, but does not initially move sleeve 43 downwardly. Camming assembly tubes 84–86 are moved downwardly because of the threaded connection of tube 84 to valve housing 44 at threaded connection 70. When sink 107 reaches ball detent 103, sleeve 43 is declutched from body member 10 and also moves downwardly, the pin 108 moving in the groove of upper barrel cam 81, the upper barrel cam 81 being formed on the exterior of camming assembly tube 84. The action of pin 108 in the groove of the upper barrel cam causes stepwise rotation of camming assembly tube 84 when the tube 84 is moved back up after pressure is relieved. At the same time, the lower barrel cam 82, the configuration of which is shown in FIG. 9, acts to rotate the lower camming assembly tube 86, and forces the lower body member 12 in rotation to change its angle at surfaces 11*a*, 12*a*. The incremental rotations of camming assembly tubes 84 and 86 are completed on the tube upstrokes, that is, when pressure above ball 50 is relieved and the ball opens and the springs 71 and 121 move the camming assembly tubes upwardly, as can be seen by study of the cam configurations in FIGS. 8 and 9. Thus, when pressure is increased above ball valve 50 to move the camming assembly tubes downwardly and then released so that they move upwardly, rotations of camming assembly tubes 84 and 86 occur. The lower barrel cam causes rotation of lower body member 12 to cause angular and rotational deviation thereof, and the opposite rotational deviation caused by the upper barrel cam maintains the angular deviation of tube 12 in a single fixed plane. Thus, the angular deviation of lower body member 12 can be taken through the steps corresponding to the parallel grooves of the lower barrel cam 82 from 0 degrees initially, to $\frac{5}{8}$ degrees, $1\frac{3}{8}$ degrees, 2 degrees, and finally to $2\frac{1}{2}$ degrees and then back to zero by reverse sequence. This is done by the sole steps of increasing the drill string pressure and then reducing it. This procedure may be repeated as often as desired and in a rapid, efficient manner without running any tool down the drill string.

Restriction of the movement of fluid around the enlarged diameter of ball housing 44 damps the motion of the upper camming tube 84. The lower extension of lower camming tube 86 inside spring 121, encounters a reduced bore section when it moves through the bore of lower spring stop 122 prior to completing a full stroke. A flow restriction thus results for the fluid entering the space between the lower extension of part 86 and the lower spring stop 122, thus damping the motion of the lower tube 86. These damping features prevent impact of the camming pins within the upper and lower barrel cam grooves, and eliminate shock to the apparatus.

The bore 93 of lower body member 12 is preferably at an angle of 1.25 degrees to the tool axis (the axis of members 10–11). The angularities of the engaged ends 11*a*, 12*a* of members 11–12 are also preferably 1.25 degrees. When members 11, 12 are rotated such that their end angularities are opposed to cancel one another, then the axes of members 11–12 coincide. When members 11–12 are rotated so that their full end angularities are additive, then since the axis of rotation of member 12 is at 1.25 degrees with respect to the axis of member 11 (the tool axis), member 12 is in a rotative position such that the angularity of its bore 93 with respect to the tool axis is 2.5 degrees (1.25° bore angle +1.25° member 12 angle).

As has been mentioned, member 12 is rotated stepwise with respect to tube 86 as pin 118 moves along the course of upper barrel cam 82 (see FIG. 9). The cam grooves, acting through pin 118, force member 12 to rotate around tube 86, the cam being in tube 86 and pin 118 being carried by body member 12. Movements of pin 118 in longitudinal (parallel to the cam 86 axis) courses a–n of cam 82 do not rotate member 12, but movements of pin 118 in angular courses at the lower and upper ends of the cam groove cause member 12 rotations. The arrows in FIG. 9 show pin movements along the cam groove, and it should be understood that a relative upward pin 118 movement corresponds to an actual downward movement of tube 86, and vice versa.

Referring to FIG. 8, pin 108 moves along the course of upper barrel cam groove 81 in a similar manner, causing rotation of tube 84 (and rotatably coupled tubes 85, 86 therebelow) as the pin moves along the angular portions of the cam groove.

It should be noted that groove 81 has eight angular slot portions which correspond with the eight stages of groove 82, so that the action of cam groove 81 cancels rotation of the angular position of bore 93 for each full increment stage of its rotation by cam groove 82, so that the angular position of bore 93 remains in a fixed plane, and angular boring tendencies of the non-rotating drill string remain in a fixed plane. The drill string does not rotate during drilling, the drill bit being motor driven at the lower end of the drill string. The cam groove patterns 81, 82 can be altered to give different numbers of steps or different step sizes for increasing versus decreasing bends.

Referring to FIGS. 10–11, to explain further the functions of cam grooves 81 and 82, when lower mandrel body 86 rotates to rotate lower body member 12, the axis of lower body member 12 rotates in a circle away from and then back to the tool axis. Body member 12, FIG. 11, has the arcuate movements A–B, B–C, C–D, D–E, E–F, F–G, G–H, and H–A, totaling a full circle. The lengths of the arcs correspond to the groove spacings of the lower cam groove 82, FIG. 9. Note that point B is at a greater angle with diameter A–E (the plane of the bend of body member 12), than is point C. Points D, E have successively smaller angles with diameter A–E. Therefore, when lower body member 12 rotates from A to B, the counter rotation by upper barrel cam 81 must move body 12 back to plane A–E, through angle $\phi_1$. Then when body member 12 rotates to point C, the counter rotation by cam 81 is to a smaller angle with plane A–E, so that the second step of cam 81 (angle $\phi_2$) is in the opposite direction to the first step of groove 81. Study of FIGS. 10–11 will explain the complete shape of cam groove 81 (FIG. 8).

For each full movement of pins 108, 118 along their respective cam grooves, tube 84 makes a partial rotational orbit within member 10 and member 12 makes a full rotation about tube 86, so that the bore 92 moves from 0° angularity through angular steps to maximum 2.5° angularity, and then stepwise back to 0° angularity. Drilling may be done with bore 92 at any selected stepwise angularity corresponding to available barrel cam positions.

The two dashed lines in FIG. 9 indicate the same position of barrel cam 82, which is cylindrically disposed about tube 86.

The described apparatus is operated in a simple manner, by simply increasing the pressure within the drill string and then reducing it, repeatedly for repeated deviations for the lower body section 12. The operation of the apparatus is entirely controlled and virtually fool proof, so that field use is accomplished without complications or breakdowns. Thus, an improved apparatus is provided which performs in an entirely suitable manner to permit angularly deviated well boring operations as and when desired.

While a preferred embodiment of apparatus according to the invention has been described and shown in the drawings, many modifications thereof may be made by a person skilled in the art, without departing from the spirit of the invention, and it is intended to protect by Letters Patent all forms of the invention falling within the scope of the following claims.

I claim:

1. Directional drilling apparatus, comprising a tubular apparatus body having upper, middle and lower sections, a camming body having upper, middle and lower tubes disposed through said body sections, said tubes being connected end-to-end by universal joints, said upper and middle body sections being connected mutually rotatably end-to-end, said middle and lower body sections being connected mutually rotatably end-to-end at surfaces which are angular to perpendicular to the longitudinal apparatus axis whereby rotations therebetween cause changes in angularity therebetween, said lower tube being disposed within the bore of said lower body section which is angularly askew with respect to the axis of said lower body section and said longitudinal apparatus axis, first mutual engagement means between said lower body member and said lower tube for rotating said lower tube when said camming body is moved reciprocably downward and upward within said tubular apparatus body, second mutual engagement means between a sleeve releasably fixed within said upper body member and said upper tube for rotating said upper tube when said camming body is moved reciprocably downward and upward within said tubular apparatus body, said upper and lower tubes being restrained against rotations within said respective upper and lower body members, rotation of said lower tube causing rotation of said lower body member to change its angularity with respect to said longitudinal apparatus axis whereby drilling angular to a drill string portion connected to the upper portion of the apparatus may be done by a drill string portion connected to the lower end of the apparatus, said rotation of said upper tube being equal and opposite to said rotation of said lower tube whereby said change in the angularity of said lower body member occurs in a single fixed plane through said longitudinal apparatus axis.

2. The combination of claim 1, wherein said first and second mutual engagement means comprise first and second barrel cams on one mutually engaged member and a pin engaged with each said barrel cam carried by the other mutually engaged member.

3. The combination of claim 2, wherein each said barrel cam causes a stepwise fractional rotation of said rotated member for each said reciprocal downward and upward movement of said camming body within said tubular apparatus body, whereby said lower body member is moved from a position of zero angularity through successively increasingly angular positions to a position of maximum angularity and then through successively decreasingly angular positions to said position of zero angularity.

4. The combination of claim 3, wherein said first barrel cam comprises a continuous contoured groove around the exterior of said lower tube and said engaged pin is carried by said lower body member, and wherein said second barrel cam comprises a continuous contoured groove around the exterior of said upper tube and said engaged pin is carried by said sleeve.

5. The combination of claim 4, including releasable clutch means connecting said sleeve within said upper body member, said clutch means being released to permit longitudinal movements of said sleeve within said upper body member to prevent bottoming out of said engaged pin in said second barrel cam groove.

6. The combination of claim 4, including valve means disposed within the upper end of said upper body member, piston means adapted to close said valve means when moved down by increased fluid pressure within said upper body member, spring means biasing said piston means upwardly to open said valve means when pressure within said upper body member is reduced.

7. The combination of claim 6, said valve means comprising ball valve means.

8. The combination of claim 6, increased fluid pressure above said valve means when said valve means is closed driving said camming body downward, said camming body being spring biased to move upwardly when said fluid pressure above said closed valve means is reduced, whereby said apparatus is operable to change the angularity of said lower body member by increasing and then reducing the fluid pressure within said upper body member from the surface.

9. The combination of claim 8, including pressure precharged accumulator means the pressure within which normally retains said piston means in an upward position to maintain said ball valve means open, and the pressure within which is overcome by increased fluid pressure within said upper body means to drive said piston means down to close said ball valve means.

10. Directional drilling apparatus for incorporation into a drill string, comprising a tubular body having upper, middle, and lower sections, actuating means for moving said lower section to an out of line angular direction with respect to said upper and middle sections, said upper and middle body sections having aligned concentric cylindrical passages longitudinally therethrough, said lower body section having a cylindrical passage longitudinally therethrough which is angular with respect to said upper and middle body section passages and which is angular with respect to the axis of said lower body section, said lower body section angularity and the angularity of said lower body section passage being in a single plane and thereby being additive to produce directional drilling at an angle equal to their sum.

11. Directional drilling apparatus for incorporation into a drill string, comprising a tubular body having upper, middle and bottom sections, said middle section being rotatable with respect to said upper section and said lower section being rotatable with respect to said middle section, said lower body section having a bore at an angle to its longitudinal axis and to the coaxial bores of said upper and middle body sections, tubular mandrel means received in said tubular body and having upper, middle and lower sections, said mandrel means and said body means having cooperating upper cam means adapted to rotate said mandrel means upon downward and return upward movement of said mandrel means within said tubular body, said upper and middle body sections being axially aligned, said middle and lower body sections being engaged at ends which are each angular from perpendicular to the axis of said tubular body whereby when said middle and lower body sections are rotated with respect to one another with said angular ends abutted the angle therebetween changes between a minimum angle when they are disposed whereby their end angularities are mutually opposite to a maximum angle when they are disposed whereby their end angularities are additive, said mandrel means and said body means having cooperating cam means adapted to rotate said lower body section upon downward and return upward movement of said mandrel whereby said angular bore is rotated with said lower body section to become more angular by the amount of resulting angular deviation of said lower body section, connection means at the upper and lower ends of said tubular body for connection into a drill pipe string whereby the portion of said drill pipe string therebelow will be deviated in direction from the portion of said drill pipe string thereabove to accomplish angular deviation of the direction of drilling with said drill string.

12. The combination of claim 11, said first and second cam means causing said respective rotation and counter-rotation by relative axial movements of barrel cams with respect to pin means engaged in said barrel cams.

13. The combination of claim 12, wherein said mandrel body has a valve at its upper end, said valve being adapted to be closed by a predetermined pressure increase within said housing body whereby said mandrel body is moved downwardly by said increased pressure in said housing body, means biasing said mandrel body upwardly when said increased pressure is reduced below said predetermined pressure increase to move said mandrel body upwardly, said downward and upward mandrel body movements causing compensating rotations at said barrel cam means.

14. The combination of claim 13, said biasing means including precharged pressure accumulator means adapted to oppose downward movement of said mandrel body means.

15. The combination of claim 14, said biasing also including spring means.

16. Well apparatus, comprising an inner sectional tubular mandrel body disposed through an outer sectional housing body, said mandrel body having a lower section rotatable within a lower section of said housing body to rotate said lower section of said housing body to cause angularity of said lower section of said housing body because of an angular engagement of the upper end thereof with a section of said housing body thereabove, the upper portion of said mandrel body being rotatable counter to said rotation of said lower section of said housing body so that said angularity of said lower section of said housing body caused by rotation thereof is in a single predetermined direction.

17. In a well apparatus, first means for causing rotation of a lower apparatus portion to create angularity thereof with respect to upper apparatus portions, second means for simultaneously compensatingly rotating said lower apparatus portion whereby said angularity is created only in a predetermined direction.

18. Well apparatus for use in directional drilling of wells, comprising an outer housing tube formed by three upper, middle, and lower sections mutually rotatably connected end-to-end, an inner mandrel tube formed by three upper, middle, and lower sections disposed within said outer tube and connected end-to-end by universal joints, said upper and middle housing tube sections having concentric coaxial aligned bores and said lower housing tube section having a bore which is angular to said concentric coaxial aligned bores, said middle and lower sections of said outer tube being engaged end-to-end at angular surfaces whereby relative rotations therebetween cause changes in angularity therebetween.

19. The combination of claim 18, including a first barrel cam groove around said lower section of said inner mandrel and a pin engaged therewith carried at the interior of said lower section of said outer housing tube, said first cam groove having a shape which produces stepwise rotation and angularity of said outer housing tube when said inner mandrel is moved downwardly and returned upwardly.

20. The combination of claim 19, said upper section of said mandrel tube having a second barrel cam groove therearound, and said upper housing tube section having a sleeve fixed therein having a pin engaged with said second barrel cam groove, said second barrel cam groove having a shape which produces stepwise rotation of said upper section of said mandrel tube in the direction compensating for said rotation produced by said first barrel cam shape when said mandrel tube is moved downward and returned upward, whereby said stepwise angularity of said lower section of said outer housing tube is maintained in a fixed direction.

21. The combination of claim 20, wherein said mandrel tube is moved downward by increased fluid pressure in said housing tube above a closed valve at the upper end of said mandrel tube, and wherein said mandrel tube is returned upward when said fluid pressure is reduced.

22. The combination of claim 21, wherein said valve is closed by said increased fluid pressure and is opened when said fluid pressure is reduced.

23. The combination of claim 22, wherein said upper section of said housing tube has an accumulator space therewithin, and wherein fluid pressure in said accumulator space opposes closing of said valve, whereby said fluid pressure in said accumulator must be overcome by said increased fluid pressure before said valve will close.

24. The combination of claim 23, wherein said valve is a ported ball valve which is rotated from open to closed condition by pin means acting in groove means in response to downward movement of piston means exposed at one surface means to accumulator pressure and at the other surface means to said increased fluid pressure.

25. The combination of claim 24, wherein said lower housing section has an angular bore the angularity of which is additive with said angularity of said lower housing section produced by said rotation of said lower mandrel section.

26. The combination of claim 18, 19, 20, 21, 22, 23 24 or 25, wherein an upper length of drill string is connected to the upper end of said upper housing section and wherein a lower length of drill string is connected to the lower end of said lower housing section, operation of said apparatus causing angularity of said lower drill string length with respect to said upper drill string length to achieve angular directional drilling which is controlled entirely from the surface by controlling pressure within said upper drill string length.

27. Apparatus for performing work in well, comprising a tubing disposed through a well hole from the surface, a tubular mandrel slidable in said tubing having pressure responsive valve apparatus disposed therein adapted to be closed by increase of tubing pressure and to be opened by decrease of tubing pressure, said valve apparatus when closed being capable of rotation only about the longitudinal axis of said tubing and being adapted to function as a piston movable downwardly by tubing pressure to do work on well apparatus associated therewith.

28. The combination of claim 27, including means at the surface for increasing or decreasing tubing pressure to operate said valve apparatus.

29. The combination of claim 28, said valve apparatus including pressure accumulator means biasing said valve apparatus toward opened condition.

30. The combination of claim 29, said valve apparatus comprising a ball valve having a diametric flow passage therethrough and being adapted to be rotated by 90° between its opened and closed positions.

31. The combination of claim 30, said ball valve being rotatively supported by opposite diametrically disposed pins and being rotated by movements of oppositely disposed pins eccentric to said opposite diametrically disposed pins which are slidably disposed in slots formed in said ball.

32. The combination of claim 28, said valve apparatus comprising a ball valve having a diametric flow passage therethrough and being adapted to be rotated by 90° between its opened and closed positions.

33. The combination of claim 32, said ball valve being rotatively supported by opposite diametrically disposed pins and being rotated by movements of oppositely disposed pins eccentric to said opposite diametrically disposed pins which are slidably disposed in slots formed in said ball.

34. The combination of claim 27, said valve apparatus comprising a ball valve having a diametric flow passage therethrough and being adapted to be rotated by 90° between its opened and closed positions.

35. The combination of claim 34, said ball valve being rotatively supported by opposite diametrically disposed pins and being rotated by movements of oppositely disposed pins eccentric to said opposite diametrically disposed pins which are slidably disposed in slots formed in said ball.

36. The combination of claim 35, said eccentric pins being moved by vertical movements of said piston formed by said mandrel.

37. The combination of claim 27, said pressure responsive valve being a full opening valve and said apparatus having a fully open bore therethrough when said valve is fully open.

38. The combination of claim 27, said pressure responsive valve being a quick-closing valve which when moved to closed condition causes a water hammer pulse detectable at the surface through the fluid in said tubing as in indication that said valve has been closed.

39. The combination of claim 27, said pressure responsive valve being movable to partially closed positions restricting but not stopping fluid flow therethrough, by appropriate adjustment of tubing pressure.

40. In a well apparatus, a first tube means extending downwardly from the surface and lining a well, a second tube means slidable vertically in said first tube means, valve means in said second tube means closable by increased pressure in said first tube means, said valve means serving as a pilot valve functioning to adapt said second tube means to function as a piston in said first tube means when closed, whereby increased pressure in said first tube means applied from the surface closes said valve means and moves said second tube means downward as a piston means capable of performing work in the well.

41. The combination of claim 40, said second tube means being spring biased to move upward when the pressure in said first tube means is sufficiently low.

42. The combination of claim 41, said valve means being biased to open when the pressure in said first tube means is sufficiently low.

43. The combination of claim 42, wherein said valve means bias is applied at least in part by a pressure accumulator associated therewith in the well.

* * * * *